US007213515B2

(12) United States Patent
Shimokawa et al.

(10) Patent No.: US 7,213,515 B2
(45) Date of Patent: May 8, 2007

(54) DATA CREATING DEVICE FOR A PRINTING PLATES

(75) Inventors: Kozo Shimokawa, Fuchu (JP); Yasuhiko Kimura, Fuchu (JP)

(73) Assignee: Ryobi Ltd., Hiroshima-Ken (JP)

( * ) Notice: Subject to any disclaimer, the term of this patent is extended or adjusted under 35 U.S.C. 154(b) by 260 days.

(21) Appl. No.: 10/992,476

(22) Filed: Nov. 18, 2004

(65) Prior Publication Data

US 2006/0102031 A1 May 18, 2006

(51) Int. Cl.
*B41C 3/08* (2006.01)

(52) U.S. Cl. ..... 101/401.1; 101/477

(58) Field of Classification Search ..... 101/481, 101/401.1, 378, 415.1, 418, 477, 382.1; 430/204
See application file for complete search history.

(56) References Cited

U.S. PATENT DOCUMENTS 6,782,825 B2 * 8/2004 Sejima et al. ..... 101/477
6,889,607 B2 * 5/2005 Eisele et al. ..... 101/415.1

FOREIGN PATENT DOCUMENTS

| | | |
|---|---|---|
| JP | 4-142875 | 5/1992 |
| JP | 2001-201841 | 7/2001 |
| JP | 2002-166523 | 6/2002 |

OTHER PUBLICATIONS

Patent Abstracts of Japan, Publication No. 2002-166523, Publication Date Jun. 11, 2002, 1 page.

Patent Abstracts of Japan, Mechanical English Translation of Japanese Patent Application No. 2002-166523, 13 pages.

English translation of Japanese Notification of Reasons for Refusal for Patent Application No. 2002-355399, issued on Dec. 16, 2005, 3 pages.

Japanese Notification of Reasons for Refusal for Patent Application No. 2002-355399, issued on Dec. 16, 2005, 2 pages.

Mechanical English translation of Japanese Patent Application Laid-Open No. 2001-201841, Date of Publication Jul. 27, 2001, 4 pages.

Patent Abstracts of Japan, Publication No. 04-142875, Publication Date May 15, 1992, 2 pages.

* cited by examiner

*Primary Examiner*—Minh Chau
(74) *Attorney, Agent, or Firm*—Osha Liang LLP

(57) ABSTRACT

A data creating device for printing plates optimizes image data for use in forming printing plates using a printing press having a feed reel for feeding printing film onto a circumference of a plate cylinder from a circumference recess formed in the plate cylinder, a rewind reel for rewinding the printing film fed from the feed reel so as to draw the printing film from the circumference of the plate cylinder, and an image forming device for forming an image on the printing film placed on the circumference of the plate cylinder. The data creating device detects a maximum position of the image data in a plate transfer direction. The data creating device deletes data downstream of the maximum position in the plate transfer direction, thereby creating optimized image data. The data creating device stores the optimized image data in a memory to be used in forming the printing plate.

5 Claims, 11 Drawing Sheets

DATA CREATING DEVICE FOR A PRINTING PLATES

FIELD OF THE INVENTION

The present invention relates to a data creating device for printing plates that optimizes image data for use in forming printing plates.

BACKGROUND ART

As illustrated in FIG. 9, a conventional printing unit of a digital printing press includes plate cylinder 2, which carries printing film 1 therearound and rotates, ink feeding part 3 for feeding ink on the printing film 1 on the plate cylinder 2, rubber cylinder (not shown) onto which ink is transferred from the printing film 1, and an impression cylinder (not shown) for pressing and holding a printing sheet with the rubber cylinder so as to enable the ink to be transferred from the rubber cylinder to the printing sheet.

The printing press of FIG. 9 is so structured that the printing film 1 having such a length as to enable several images to be formed thereon is rolled up and set to the plate cylinder 2 for easy replacement of the printing film 1. Specifically, the plate cylinder 2 forms on its circumference recess 4, in which a roll of the printing film 1 is mounted, and includes feed reel 5 for feeding the printing film 1 onto the circumference of the plate cylinder 2, and rewind reel 6 for rewinding the printing film 1 by holding the leading edge 1*a* thereof so as to draw the film from the circumference of the plate cylinder 2.

Once the printing film 1 is set on the plate cylinder 2, image forming device 7, which is secured in place with a predetermined clearance to the circumference of the plate cylinder 2, forms an image on the printing film 1 placed on the circumference of the plate cylinder 2 so as to use the printing film 1 as a printing plate. The ink feeding part 3 feeds ink on the printing plate (the printing film 1) or performs any other operations so that the image is printed on the printing sheet via the rubber cylinder.

Subsequent to completing series of printing operations, the rewind reel 6 rewinds the printing film 1, which was used as the printing plate, so as to draw the same from the circumference of the plate cylinder 2, while the feed reel 5 successively feeds a new printing film 1 onto the circumference of the plate cylinder 2. That is, in the printing press having the printing unit as illustrated in FIG. 9, an image can newly be formed on the printing film 1 fed from the feed reel 5 by the image forming device 7, thereby enabling repeated printing operations without the necessity to replace the plate every time the printing operation is performed.

In a case where color printing (multi-color printing) is performed by using the aforesaid digital printing press, plural printing units as illustrated in FIG. 9 are provided. The printing unit of FIG. 9 is designed for a two-color printing, and therefore two printing units are provided to make up a digital printing press, in a case where the printing operation is performed by having four colors, namely C (cyan), M (magenta), Y (yellow) and K (black) overlapped to each other.

In the thus arranged digital printing press, image data (color separated, four image data) for the respective printing plates used in the printing units are created, thereby forming a printing plate in each printing unit based on each image data.

Image data for the respective printing plates must be prepared so as to achieve correct alignment of colors during printing. For the correct alignment of colors in printing, marks called "register marks" for the alignment are generally printed in a space near the edge of a substrate, and image data for each printing plate contains data (register mark data) for laying out register marks. This register mark data is also utilized to provide marks in sheet cutting operation in addition to an operation to adjust the alignment of colors in printing.

FIG. 10 respectively illustrate image data for the respective printing plates used in a digital printing press according to a conventional technique. As illustrated in FIG. 10, in the conventional technique, all the image data for the respective printing plates contain register mark data T1-T8. Herein, FIGS. 10(*a*), 10(*b*), 10(*c*) and 10(*d*) illustrate image data created respectively for a C plate, a M plate, a Y plate and a K plate.

The respective printing plates are formed based on the image data created respectively for them in FIG. 10. FIG. 11 illustrates a print formed by using these printing plates. As illustrated in FIG. 11, print 100 containing an illustration (a logo), a color picture, text and register mark data T1-T8 is made (Japanese Patent Application Laid-open No. 2002-166523).

The digital printing press made up of plural printing units as described above provides alignment with high accuracy and therefore there is a case where register mark data is not needed when it is presented for the purpose of adjustment of alignment of colors in printing. In such a case, it is possible to create each image data that contains no register mark data. Accordingly, in this case, the printing plates are formed based on image data without register mark data, overprinting is made by these printing plates, thereby making the print 100 as illustrated in FIG. 11.

However, according to the above conventional technique, whether register mark data are contained or not, image data created for forming the printing plates are allowed to have only a uniform size. That is, the printing film 1 for use in forming printing plates provides a uniform size for all the printing plates, regardless of presence or absence of an image to be printed, the size or the like of an image for each plate. There is a case where the size of an image to be printed is very small depending on the plate, which results in inefficient consumption of the printing film 1.

For example, in each of the C plate (see FIG. 10(*a*)), the M plate (see FIG. 10(*b*)) and the Y plate (see FIG. 10(*c*)), a portion S with no data except for register marks written therein is caused. That is, if this portion S in each of the C, M and Y plates is not served to provide a register mark, which means that this portion is not used in printing by all means, the digital printing press according to the conventional technique inefficiently consumed the printing film 1.

The present invention has been conceived to address a problem associated with the above conventional technique. It is an object of the present invention to provide a data creating device for printing plates that optimizes image data for printing process by using a minimum amount of a printing film.

SUMMARY OF THE INVENTION

In order to address the above problem, according to the present invention, there is provided a data creating device for printing plates that optimizes image data for use in forming printing plates, the data creating device being characterized in that a maximum position of the image data with respect to a plate transfer direction is detected; and data downstream to the maximum position with respect to the plate transfer direction is deleted, thereby creating optimized image data.

There is also provided a data creating device for printing plates that optimizes image data for use in forming printing plates, the data creating device being characterized in that register mark data in the image data is deleted; a maximum position of the image data with respect to a plate transfer direction is detected; and data downstream to the maximum position with respect to the plate transfer direction is deleted, thereby creating optimized image data.

In a data creating device for printing plates according to the present invention, color designation of 0 is preferably applied to printing plates other than a predetermined printing plate at the time of creating the register mark data, thereby deleting the register mark data.

In a data creating device for printing plates according to the present invention, a registration color is preferably not formed in image data for printing plates other than a predetermined printing plate by a RIP that creates image data, thereby deleting the register mark data for the printing plates other than the predetermined printing plate.

In a data creating device for printing plates according to the present invention, it is preferable to employ an arrangement where a RIP for creating image data creates converted data that have been converted to image data based only on data to which a registration color has been designated; XOR is calculated between the converted data and data for the printing plates other than the predetermined printing plate, thereby deleting the register mark data for the printing plates other than the predetermined printing plate.

According to the present invention, it is possible to produce a data creating device for printing plates that optimizes image data so as to enable printing operation by using a minimum amount of a printing film.

BRIEF DESCRIPTION OF THE DRAWINGS

FIG. 3(*b*) illustrates a state where an image for the second printing operation has been formed; and FIG. 3(*c*) illustrates a state where an image for the third printing operation has been formed.

FIG. 8(*a*) illustrates optimized image data created for a C plate; FIG. 8(*b*) illustrates optimized image data created for a M plate; FIG. 8(*c*) illustrates optimized image data created for a Y plate; and FIG. 8(*d*) illustrates optimized image data created for a K plate.

FIG. 10(*a*) illustrates optimized image data created for a C plate; FIG. 10(*b*) illustrates optimized image data created for a M plate; FIG. 10(*c*) illustrates optimized image data created for a Y plate; and FIG. 10(*d*) illustrates optimized image data created for a K plate.

DESCRIPTION OF THE PREFERRED EMBODIMENTS

An example of an embodiment of the present invention will be herein described with reference to the drawings attached hereto.

Figure 1:
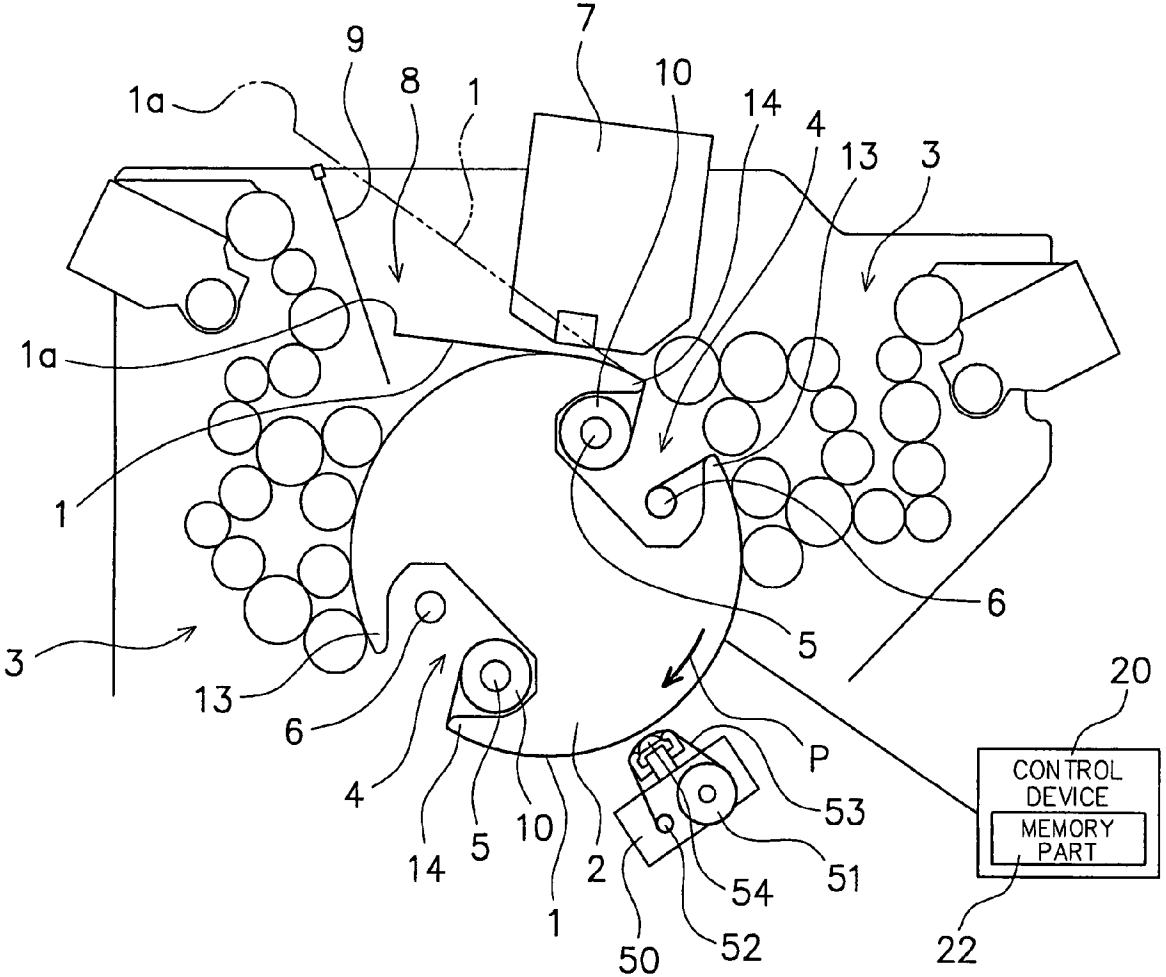
FIG. 1 is a schematic view of an essential part of a printing unit according to one embodiment of the present invention.
Figure 9:
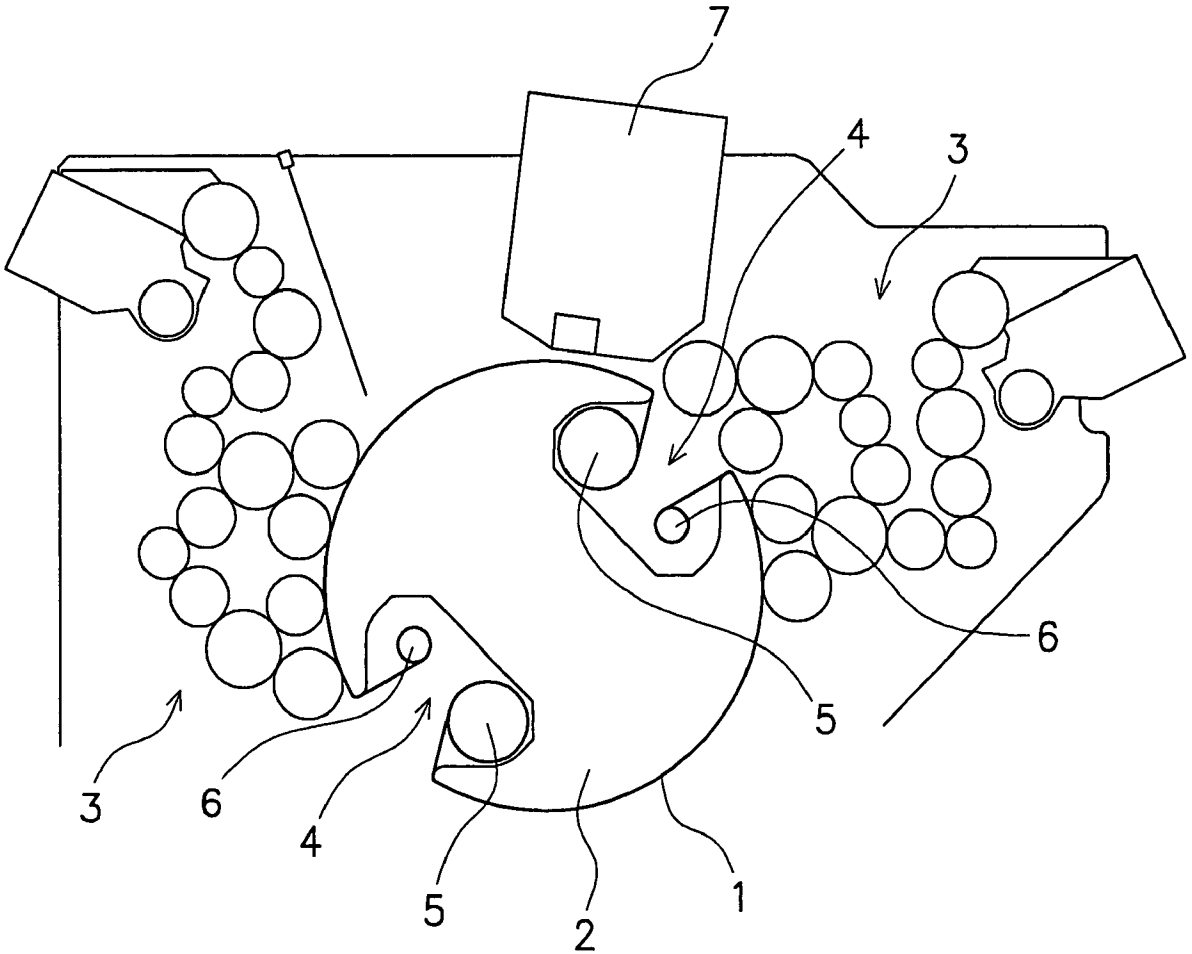
FIG. 9 is a schematic view illustrating an essential part of a printing unit according to a conventional technique.
Figures 10A, 10B, 10C, 10D:
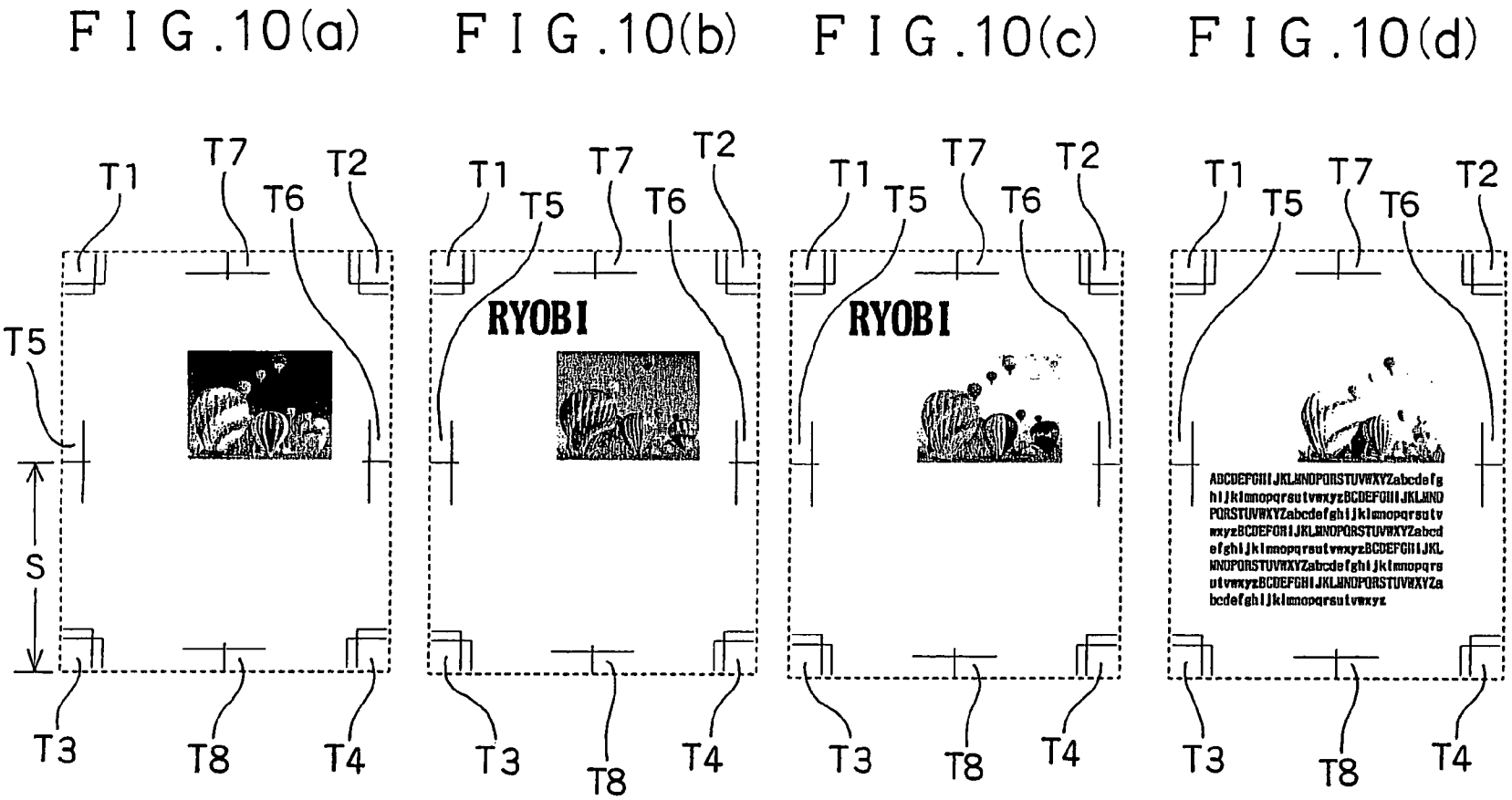
FIG. 10 illustrate an example of optimized image data for the respective printing plates used in a printing press according to a conventional technique.

FIG. 1 is a schematic view of a printing unit in a digital printing press according to an embodiment of the present invention. In FIG. 1, the same members or parts as those of the conventional printing unit of FIG. 9 are assigned the same reference numbers.

The printing unit of this embodiment is for two-color printing, so that the plate cylinder 2 is structured to place two webs of the printing film 1 around the circumference. Specifically, two printing rolls 10 for feeding the respective webs of the printing film 1 are mounted at two places. For this, two sets of the feed reels 5 and the rewind reels 6 are arranged.

Two sets of the ink feeding parts 3, each made up of several ink rollers, are also arranged so as to feed two colors of ink.

The plate cylinder 2 forms recesses 4 located on the circumference about 180 degrees opposite to one another. These recesses 4 extend in the axial direction of the plate cylinder 2, thereby each having an overall appearance of a recessed groove. By these recesses 4, the circumference of the plate cylinder 2 is divided into two sections, and the two webs of the printing film 1 are respectively placed around these sections.

The recesses 4 each are provided with the feed reel 5 for feeding a web of the printing film 1 onto a corresponding section (for one color), and the rewind reel 6 for rewinding another web of the printing film 1 on another section (for another color). The feed reel 5 and the rewind reel 6 respectively have axes extending along the axial direction of the plate cylinder 2. In the respective recesses 4, the rewind reels 6 are located on the downstream sides of the corresponding feed reels 5, so that the webs of the printing film 1 are fed from the printing rolls 10 with their rear sides slidingly engaging edges 13, 14 of the recesses 4 of the circumference.

The image forming device 7 is secured in position above the plate cylinder 2 with a predetermined clearance between its bottom and the circumference of the plate cylinder 2. On the upstream side of the image forming device 7 is provided space 8 required for setting a new web of the printing film 1 on the plate cylinder 2. Light-shielding plate 9 is located on the upstream side of the space 8 in an upright position.

Wet cleaning device (plate cleaning device) 50 and dry cleaning device (not shown) are provided near the circumference of the plate cylinder 2 to clean the printing film 1 placed on the circumference of the plate cylinder 2. The wet cleaning device 50 and the dry cleaning device are located with a predetermined clearance to the circumference of the plate cylinder 2 and designed so as to be able to be brought into contact with the printing film 1 on the circumference of the plate cylinder 2 when cleaning the printing film 1 on the circumference of the plate cylinder 2.

The wet cleaning device 50 includes cleaning cloth 53 with a cleaning liquid impregnated therein, which contacts the printing film 1 on the circumference of the plate cylinder 2, thereby cleaning the printing film 1. Specifically, the wet cleaning device 50 includes cloth-feeding part 51 with an unused cleaning cloth 53 rolled up thereon, and cloth-collecting part 52 for winding up the cleaning cloth 53 in a roll, which was used for cleaning the printing film 1. The cloth-feeding part 51 and the cloth-collecting part 52 respectively have rotating shafts extending parallel to the axis of the plate cylinder 2. Inflatable member 54 having a bag-like shape is located near the circumference of the plate cylinder 2 so as to form a passage with the circumference of the plate cylinder 2, through which the cleaning cloth 53 fed from the cloth-feeding part 51 passes and is wound up on the cloth-collecting part 52. The inflatable member 54, which has been inflated with air fed thereinto brings the cleaning cloth 53 into contact with the printing film 1 on the circumference of the plate cylinder 2. The width of the cleaning cloth 53 (the length of the cleaning cloth 53 in a direction orthogonal to the winding direction) is substantially equal to the axial length of the plate cylinder 2. Accordingly, the printing film 1, which slidingly moves along the cleaning cloth 53 by the rotation of the plate cylinder 2, can be cleaned.

The dry cleaning device (not shown) includes an elastic rotating roller made of such as rubber for scraping any foreign matters stuck on the printing film 1 on the circumference of the plate cylinder 2, and a suction part for sucking foreign matters scraped by the rotating roller. The rotating roller is shiftable between a non-contact position at which the roller is held with a predetermined clearance to the printing film 1 on the circumference of the plate cylinder 2, and a contacting position at which the roller contacts the printing film 1 on the circumference of the plate cylinder 2 and scraps foreign matters from the printing film 1. Accordingly, when the rotating roller is to scrape foreign matters from the printing film 1 on the circumference of the plate cylinder 2, it is shifted to the contact position and rotated to scrape foreign matters from the printing film 1 on the circumference of the plate cylinder 2, while the suction part sucks scraped foreign matters.

When a new web of the printing film 1 is to be set in the printing unit as illustrated in FIG. 1, the new printing roll 10 is set to the feed reel 5, and starting edge 1*a* of the printing roll 10 is pulled out from a corresponding recess 4, and the plate cylinder 2 is rotated in the P direction in FIG. 1 with pulling the starting edge 1*a*, thereby applying a tension force on the printing film 1. Thus, the printing film 1 is gradually fed on the circumference of the plate cylinder 2. After winding up a predetermined length of the printing film 1, the starting edge 1*a* of the printing film 1 is held by the rewind reel 6. Through these steps, the printing roll 10 and the printing film 1 are set to the plate cylinder 2. When the setting of the printing plate 1 on the circumference of the plate cylinder 2 has been completed, the printing operation can be performed.

Now, the description will be made for the printing operation. Once the printing film 1 is set on the circumference of the plate cylinder 2 after being subjected to the above steps, the image forming device 7, which is secured in position with a predetermined clearance to the circumference of the plate cylinder 2, forms an image on the printing film 1 placed on the circumference of the plate cylinder 2.

The printing unit of FIG. 1 is designed for a two-color printing, and therefore two printing units are provided to make up a digital printing press in a case where the printing operation is performed by having four colors, namely C (cyan), M (magenta), Y (yellow) and K (black) overlapped to each other. The printing film 1 is set in each printing unit, and the image forming device 7 forms an image on the printing film 1 set in position, based on image data optimized for each printing plate (each color) (corresponding to "optimized image data" in the present invention) (a detailed description will be made hereinafter).

The printing film 1 is coated thereon with a silicon layer, which is burned by laser radiated from the image forming device 7 so as to form an image on the printing film 1 based on the optimized image data. The image forming device 7 thus forms the image on the printing film 1 with a leading edge of each printing sheet to be printed positioned at the edge 13 of the rewind reel of the circumference of the plate cylinder 2. In other words, an image formed on the printing film 1, which is positioned at the edge 13 closer to the rewind reel 6 of the circumference of the plate cylinder 2, is printed on the leading edge of the printing sheet.

Then, silicon debris or any foreign matters stuck on the printing film 1 by forming the image are removed by the wet cleaning device 50 and the dry cleaning device (not shown).

In this embodiment, the printing film 1 with a print formed thereon and any foreign matters removed is used as a printing plate. That is, in this embodiment, the printing film 1 with an image formed thereon based on the optimized image data created for the respective printing plates is subjected to ink feeding from the ink feeding part 3 or the like operation, and the image formed on each printing film 1 is overlapped to each printing sheet, thereby producing prints.

When the second printing operation has been then started, the printing film 1 is wound up and drawn from the circumference of the plate cylinder 2 by the rewind reel 6, while it is fed from the feed reel 5. Then, after removing foreign matters from the printing film 1 on the circumference of the plate cylinder 2 by the wet cleaning device 50, a new image is formed on the printing film 1 by the image forming device 7 (a new image is formed according to optimized new image data), likewise to the previous printing operation. Thus, printing operation is made for printing sheets by using this image.

According to this embodiment, it is possible to continuously perform plural printing operations without the necessity to replace the printing plate or perform any other troublesome works as long as the current printing roll 10 remains.

In the thus arranged and operable printing unit, control device 20 is provided so as to control the amount of the printing film 1 fed from the recess 4 onto the circumference of the plate cylinder 2. This control device 20 includes memory part 22 for storing optimized image data for use in forming image on the printing film 1, and is designed to properly control the amount of the printing film 1 to be fed according to the information or the like stored in the memory part 22.

Specifically, the control device 20 is capable of performing size-control for controlling the amount of the printing film 1 to be fed from the feed roll 5 based upon the size (length) of the optimized image data for use in printing operation, and circumferential-length-based feeding control for the length of the printing film 1 to be fed from the feed roll 5 based upon the circumferential length L1 (FIGS. 2 and 3) of the plate cylinder 2 between the feed reel 5 and the rewind reel 6 so that the printing film 1 is fed from the feed reel 5 by a length substantially equal to the circumferential length L1 so as to replace a region of the printing film 1 on the circumference of the plate cylinder 2 entirely by a new region.

The optimized image data stored in the memory part 22 of the control device 20 comprise color separated, four (C, M, Y, K) image data for the respective printing plates for color printing, and each data subjected to optimization process such as deletion of register mark data and optimization of size.

The optimization process for this image data will be later described. Before that, the description will be made for the control of the feeding amount of the printing film 1 by the control device 20 with reference to FIGS. 2 to 4.

Figure 2B:
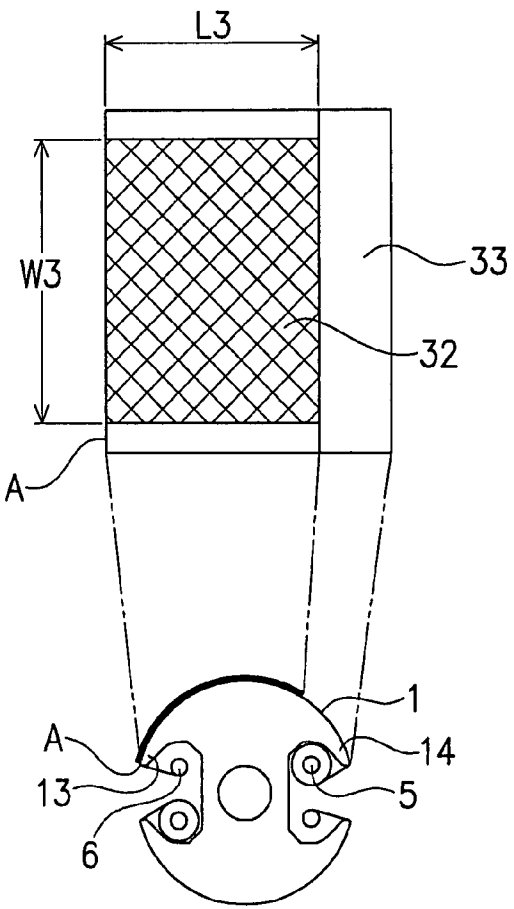
FIG. 2 are schematic views illustrating the controlling procedures (a first case) when determining the amount of a printing film to be fed from a feed reel of the printing unit of FIG. 1, in which FIG. 2(*a*) illustrates a state where an image for the first printing operation has been formed, and FIG. 2(*b*) illustrates a state where an image for the second printing operation has been formed.
Figure 2A:
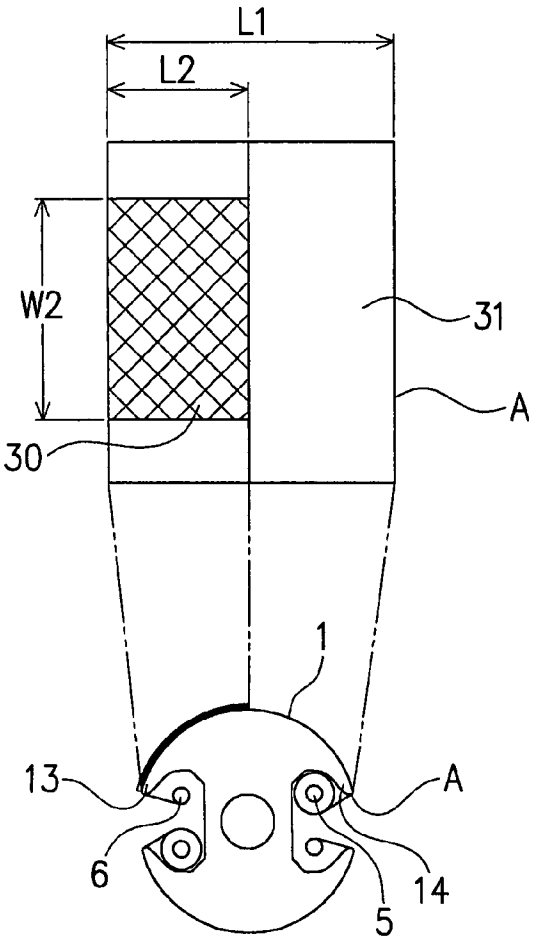
Figure 3A:
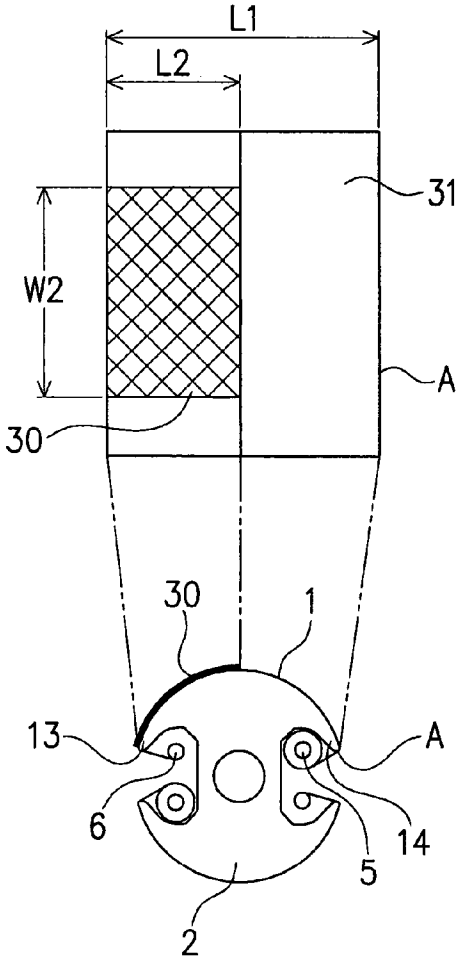
FIG. 3 are schematic views illustrating the controlling procedures (a second case) when determining the amount of a printing film to be fed from the feed reel of the printing unit of FIG. 1, in which FIG. 3(*a*) illustrates a state where an image for the first printing operation has been formed.
Figure 3B:
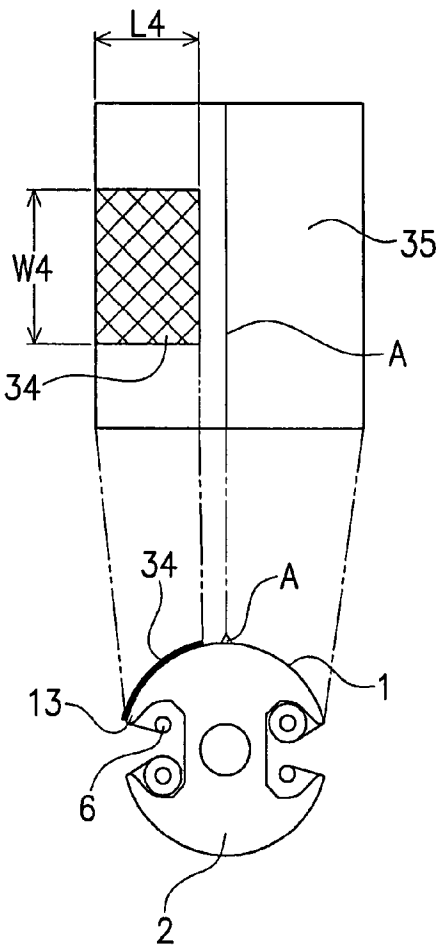
Figure 3C:
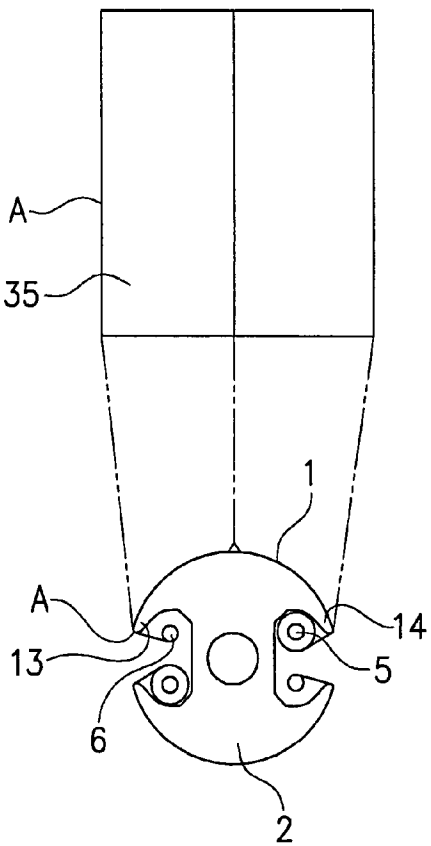
Figure 4:
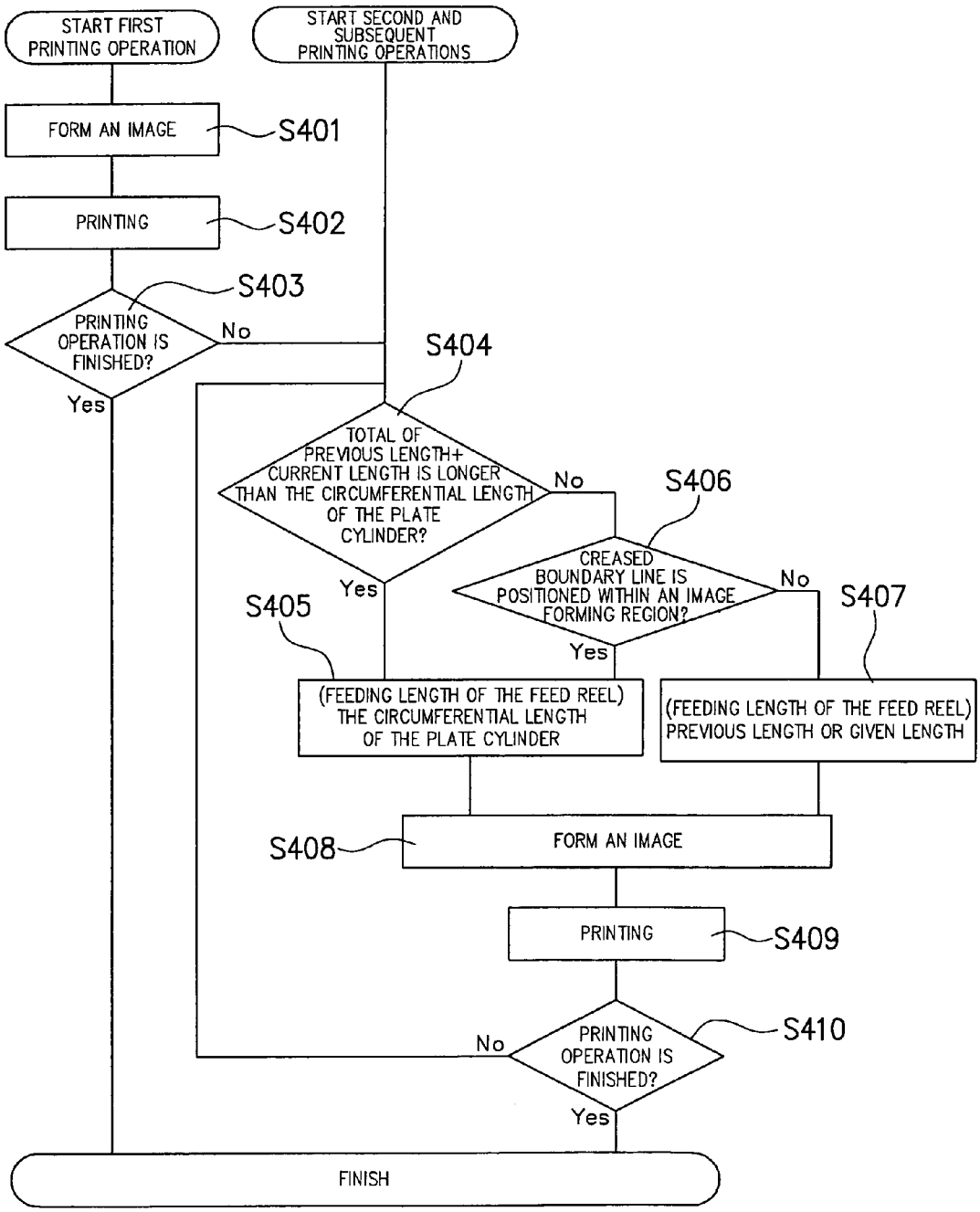
FIG. 4 is a flow chart illustrating the steps for controlling the amount of the printing film to be fed, according to this embodiment.

Upper parts illustrated in FIGS. 2 and 3 each are the circumference of the plate cylinder 2 developed in plan. FIG. 4 is a flow chart of controlling steps of controlling the amount of the printing film 1 to be fed. The description hereinafter made is based on the assumption that the information (length L and width W) relating to the optimized image data for use in forming an image.

In the first printing operation, an image is formed by the image forming device 7 within image forming region 30 (a cross-hatch part in FIG. 2(*a*)) of the printing film 1 on the circumference of the plate cylinder 2, in which the image forming region 30 of the printing film 1 based on the information on the optimized image data in the memory part 22, such as the length L2 of the image (the length corresponding to the circumference of the plate cylinder 2) and the width W2 of an image or printing sheet (Step S401). At this moment, the downstream side of the image forming region 30, that is a region closer to the feed reel 5 on the circumference of the plate cylinder 2 is designated as unused region 31 which is not used in the printing operation. In this embodiment, the printing operation is performed by using the image formed on the image forming region 30 (Step S402). Thus, the first printing operation is finished.

When the second printing operation is to be subsequently performed (that is, for the operation when "NO" is chosen at the step S403), image forming regions 32, 34 (cross-hatch parts in FIGS. 2(*b*) and 3(*b*)) are determined based on the information relating to the optimized image data stored in the memory part 22, such as the lengths L3, L4 of the images, or the widths W3, W4 of images or printing sheets. Accordingly, the control device 20 automatically controls the amount of the printing film 1 according to the length L2 (e.g., the length of the image) used in the first printing operation and the lengths L3, L4 (e.g., the length of the image) to be used in the second printing operation (Steps S404-S407).

The printing operation will be described by taking for example the first case where when the length L3 used in the second printing operation is longer than the length of the unused region 31 (L1–L2), that is, when the circumferential length L1 between a pair of the feed reel 5 and the rewind reel 6<the length L2 used in the first printing operation+the length L3 used in the second printing operation (that is, the case chosen by "YES" at the Step S404).

When the printing film 1 is fed from the feed reel 5 for the second printing operation, a region of the printing film 1 positioned at the edge 14 closer to the feed reel (a boundary between the circumference and the recess, hereinafter referred to a boundary line A, see FIG. 2(*a*)) during the first printing operation is transferred on the circumference of the plate cylinder 2. This boundary line A may be creased by a stepped portion between the circumference and the recess 4, and therefore uneven printing may be caused if an image is formed on the creased boundary line A. Therefore, an image should not be formed on the boundary line A. Accordingly, in the first case, the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region (Step S405), and an image for the second printing operation (an image formed in the image forming region 32) is formed on the printing film 1 fed from the feed reel 5, as illustrated in FIG. 2(*b*).

Now, another printing operation will be described by taking for example the second case where when the length L4 used in the second printing operation is shorter than the length of the unused region 31 (L1–L2), that is, when the circumferential length L1 between the pair of the feed reel 5 and the rewind reel 6>the length L2 used in the first printing operation+the length L4 used in the second printing operation (that is, the case chosen by "NO" at the Step S404), with reference to FIG. 3. FIG. 3(*a*) is the same figure as FIG. 2(*a*), illustrating the printing film 1 with the image forming region 30 on which the image for the first printing operation has been formed (Step S401).

In the second case, the image forming region 30 for the first printing operation is rewound by the rewind reel 6, causing the printing film 1 to be fed from the feed reel 5 by a length substantially equal to the length L2 of the image forming region 30 (Step S407), and the unused region 31 to be positioned closer to the rewind reel 6 on the circumference of the plate cylinder 2. Then, as illustrated in FIG. 3(*b*), the image for the second printing operation is formed on an image forming region 34 for use in the second printing operation according to the optimized image data, and thus the printing operation is performed by using this image. In this second case, another unused region 35 is caused on the downstream side of the image forming region 34.

In the second case (see FIG. 3), for the third printing operation, which is initiated subsequent to the finish of the second printing operation (that is, the case chosen by "NO" at the Step S410), when the length L for use in the third printing operation is longer than the length of the unused region 35 (that is, the case chosen by "YES at the Step S404), likewise to the first case described in FIG. 2, the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region, thereby preventing a creased portion from being positioned within an image forming region (Step S405).

For the third printing operation, which is initiated from the second case, when the length L used in the third printing operation is shorter than the length of the unused region 35 (that is, the case chosen by "NO" at the Step S404), this unused region 35 contains the boundary line A, as illustrated in FIG. 3B, while the printing operation can be performed by using this unused region 35.

Therefore, when the length of a portion of the unused region 35, which portion is closer to the feed reel 5 than the boundary line A is, is longer than the length L used in the third printing operation (that is, the case chosen by "NO" at the Step S406), the printing film 1 is fed from the feed reel 5 until the boundary line A is transferred to the edge 13 closer to the rewind reel 6 on the circumference of the plate cylinder 2 (Step S407). Whereby, the boundary line A is not positioned within the image forming region for the third printing operation.

On the other hand, when the length L used in the third printing operation is longer than a portion of the length of the unused region 33, which portion is closer to the feed reel 5 than the boundary line A is (that is, the case chosen by "YES" at the Step S406), the printing film 1 is fed from the feed reel 5 by a length substantially equal to the circumferential length L1 between the pair of the feed reel 5 and the rewind reel 6 so as to replace the region of the printing film 1 on the circumference of the plate cylinder 2 entirely by a new region (Step S405).

Likewise to the above, when the fourth and subsequent printing operations are continuously performed, the amount of the printing film 1 to be fed from the feed reel 5 is controlled by the control device 20 according to the optimized image data in the memory part 22, following the flow chart of FIG. 4.

Now, the description will be made for a specific method of creating optimized image data according to this embodiment. That is, the description will be made for a method of creating optimized image data for use in forming each printing plate.

Figure 5:
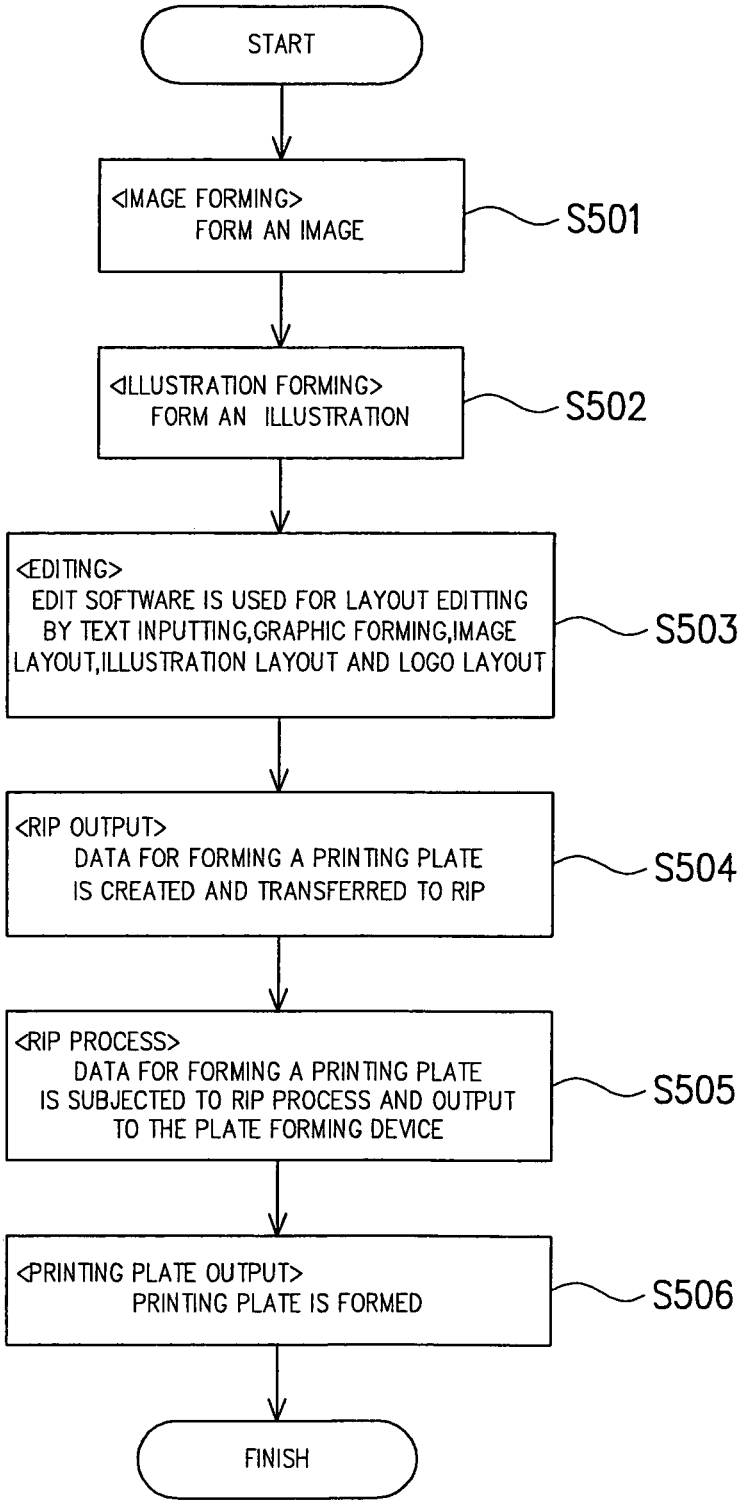
FIG. 5 is a flow chart illustrating the procedures of forming printing plates.

First, a brief description will be made for a series of steps up to forming each printing plate. FIG. 5 is a flow chart showing steps up to the formation of each printing plate.

As illustrated in FIG. 5, in this embodiment, an image forming step (Step S501), an illustration forming step (Step S502), an edit step (Step S503), a RIP output step (Step S504), a RIP processing step (Step S505) and a printing-plate output step (Step S506) are performed to form each printing plate. The image forming step and the illustration forming step in FIG. 5 are sometimes skipped.

Specifically, after forming an image, an illustration or the like by an image forming software or an illustration forming software, data created is then read by an edit software (e.g., "EP-X" manufactured by Ryobi Ltd.), while text inputting, graphic forming or the like are made by using the edit software. Those components making up a print, such as text, graphic, illustration and image are laid out by the edit software. That is, editing such as layout, scaling and rotation of the respective components is made.

After finish of the layout edit, data for forming a printing plate, which is written in a page description language represented by PostScript (registered trademark), is created by the same edit software from data of the respective components subjected to the layout edit. Then, the plate forming data is transferred to a RIP, which in turn performs a RIP process (a process to raster and convert data written in a page description language to bitmap data), and then a printing plate is formed by using data subjected to the RIP process.

In this embodiment, when forming a printing plate (S506), as described above, image data subjected to an optimization process (optimized image data) is used. Accordingly, in this embodiment, the optimization process of image data (hereinafter referred simply to "optimization process"), which will be described later, is performed prior to the printing-plate output step.

This optimization process may be performed in any step as long as it is performed prior to Step S506, and for example may be performed in the RIP processing step (S505), or after the RIP processing step (between S505 and S506). This optimization process may be performed by a device that performs the RIP processing step (e.g., a computer, etc.), using a software for the optimization process or a hardware for the optimization process. That is, in this embodiment, the timing at which the optimization process is performed, a device by which the optimization process is performed and the like are not limited to specific ones. In this embodiment, the image data, to which the optimization process has been performed, is stored in the memory part 22 in FIG. 1, and as described above, the amount of the printing film 1 to be fed is controlled based on this optimized image data.

Figure 6:
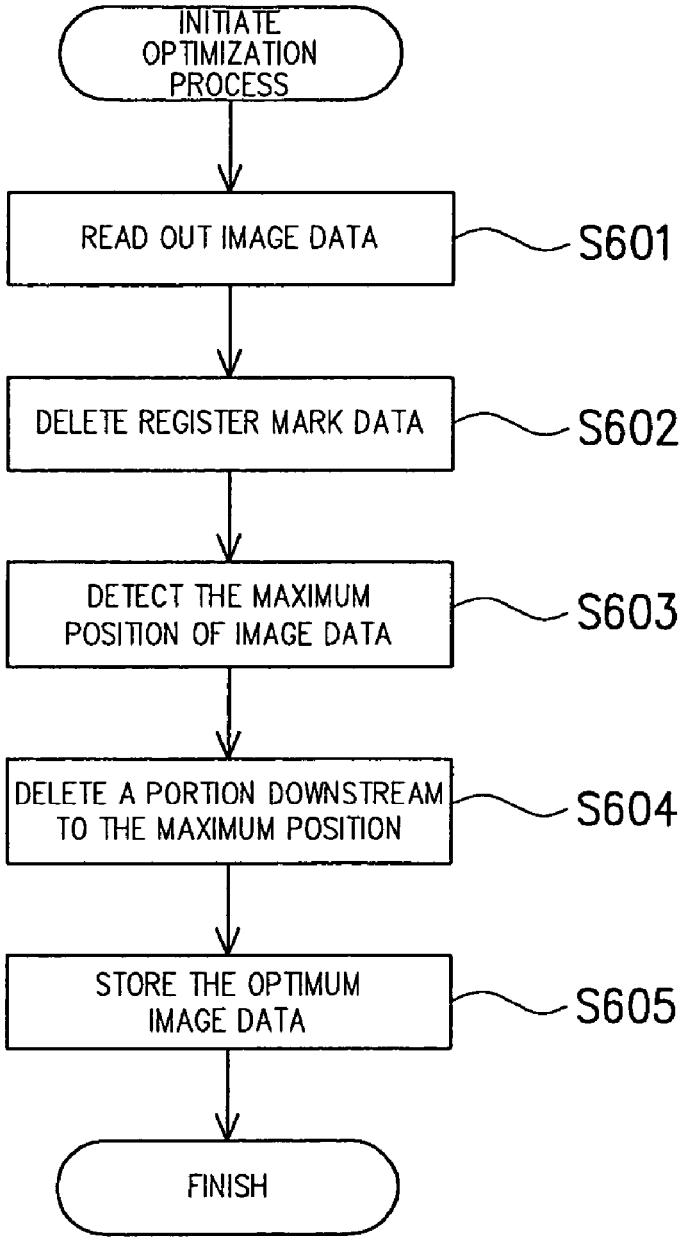
FIG. 6 is a flow chart illustrating the procedures of optimizing image data according to this embodiment.
Figures 7A, 7B, 7C:
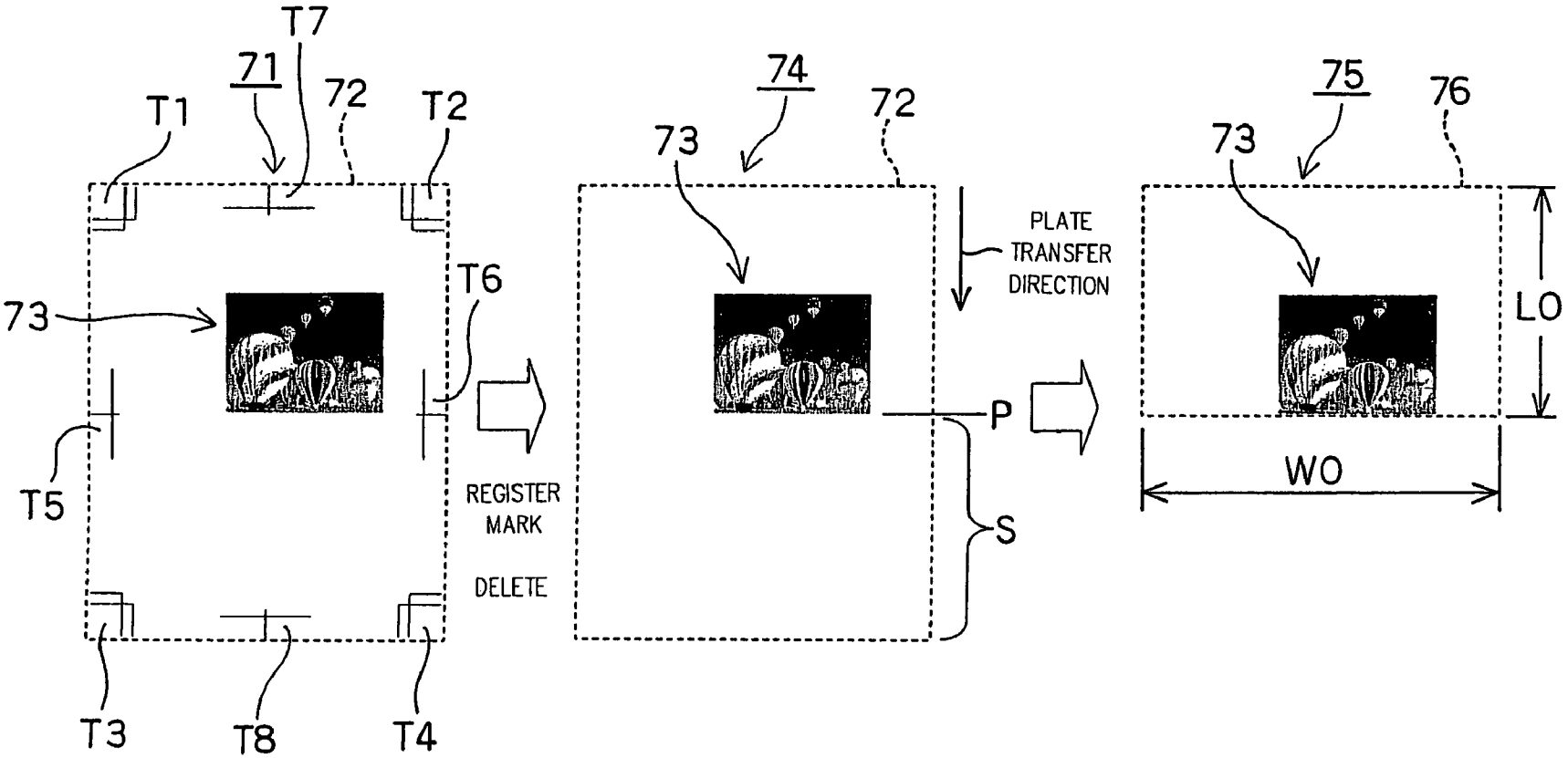
FIGS. 7(*a*)–(*c*) show a schematic illustration of optimization process of image data according to this embodiment.
Figure 8A:
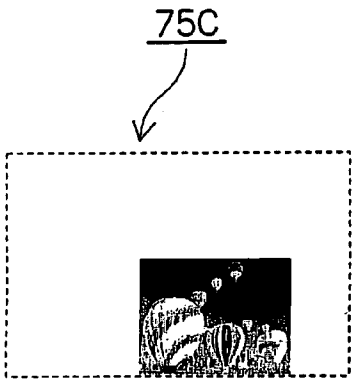
FIG. 8 illustrate an example of optimized image data for the respective printing plates used in a printing press according to this embodiment.
Figure 8B:
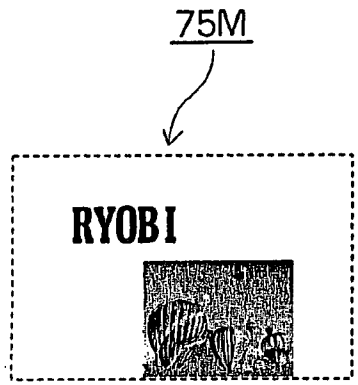
Figure 8C:
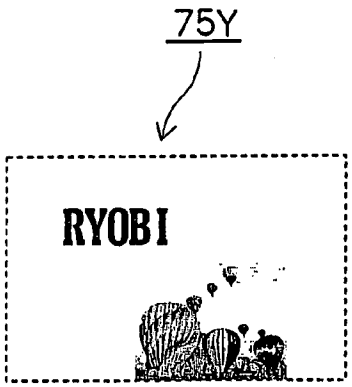
Figure 8D:
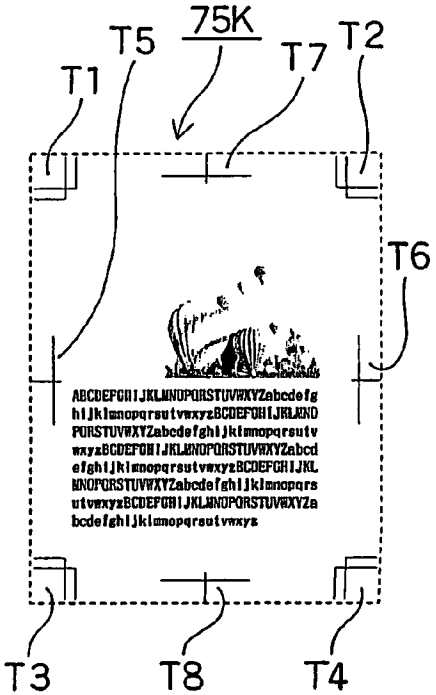

FIG. 6 is a flow chart illustrating the optimization step for image data according to this embodiment. FIGS. 7(*a*)–(*c*) show a schematic illustration of an optimization process of image data according to this embodiment. In FIGS. 7(*a*)–(*c*), a case where optimized image data is created by using image data for a C plate is shown. Now, the description will be made for the optimization process according to this embodiment with reference to FIGS. 6 and 7(*a*)–(*c*).

Once the optimization process is initiated, image data (first image data 71) (see FIG. 7(*a*)) used for forming a printing plate according to a conventional technique is read out (Step S601). This first image data 71 is one of the data groups, which were subjected to color separation for color printing (in FIGS. 7(*a*)–(*c*), data for the C plate), and contains printing-sheet frame data 72 relating to printing sheets used in printing, printing-plate outputting data 73 for use in forming a printing plate (that is, data for use in forming images or the like upon receiving ink or the like), such as image data or text data (herein, image data), and register mark data T1-T8.

Then, the register mark data T1-T8 in the first image data 71, which have been read out, are deleted (Step S602), thereby creating second image data 74 (see FIG. 7(*b*)). Deletion of the register mark data T1-T8 allows the second image data 74 to contain only the printing-sheet frame data 72 and the printing-plate outputting data 73. A method of deleting the register mark data will be later described.

Then, a maximum position P of the second image data 74 in a plate transfer direction is detected (Step S603). That is, the detection whether an image to be actually printed is laid out is made for the second image data 74 with the register mark data T1-T8 deleted therefrom in the plate transfer direction, thereby specifying a region to be kept as image data. Herein, the maximum position P is detected as an edge in the plate transfer direction for specifying the region. That is, the second image data 74 is entirely scanned in the plate transfer direction and the downstream edge of the printing plat outputting data 73 with respect to the plate transfer direction in the printing sheet frame data 72 is designated as the maximum position P. Herein, only one printing plate outputting data 73 exists in the printing-sheet frame data 72. Where multiple printing plate outputting data 73 exist, the downstream edge of the printing plate outputting data 73 that has a most downstream edge among all the printing plate outputting data 73 with respect to the plate transfer direction is designated as the maximum position P.

Then, of the image data, a portion downstream to the maximum position P detected in the process of the Step S603 is deleted (Step S604). As described above, the maximum position P corresponds to the downstream edge of the printing-plate outputting data 73 with respect to the plate transfer direction. Therefore, in this Step S604, the printing sheet frame data 72 downstream to the maximum position P is deleted. That is, a portion S that is downstream to the maximum position P in FIG. 7(*b*) is deleted.

In this embodiment, optimized image data 75 as illustrated in FIG. 7(*c*) is created by the processes of Step S601 Step S604. This optimized image data 75 contains optimized frame data 76 (length: L0, width: W0) with a portion of the data downstream to the maximum position P deleted from the printing sheet frame data 72, and the printing plate outputting data 73 within the optimized frame data 76. White exists in a portion other than the printing plate outputting data 73 within the optimized frame data 76.

This optimized image data 75 is memorized and stored in the memory part 22 of the control device 20 in order to form a printing plate (Step S605).

That is, various information of the optimized image data 75 created herein (e.g., the length up to the maximum position P: L0, the width of a printing sheet: W0, etc.) is used when the amount of the printing film 1 described in FIGS. 2–4 is automatically controlled. Specifically, as the lengths L2, L3, L4 utilized as the information of the image forming regions 30, 32, 34 in FIGS. 2 and 3, the length L0 up to the maximum position P in the optimized image data 75 is used.

In this embodiment, as illustrated in the flow chart of FIG. 6, the description was made by taking for example the case where the optimized image data is created by reading out image data (first image data) and then deleting the register mark data. This optimization process may be made for all the plates (C, M, Y, K), or may not be made for a predetermined plate, according to needs and circumstances. That is, since there is a case where register marks must be left in final prints such as for cutting, the optimization process may be made in such a manner to leave register mark data for a predetermined plate in such a case.

Specifically, where a step of determining "whether register marks must be left on a plate", is provided and performed prior to Step S601, processing immediately transfers to Step S605 and its subsequent steps when it is determined that the plate must keep the register marks thereon. Thus, the optimization process for this plate is finished.

For example, where "register marks are to be left in image data for a K plate", a step of determining "whether the data is for the K plate" is performed just after the start of the optimization process, so that where the data is for the K plate, processing immediately transfers to Step S605 and its subsequent steps, and otherwise, processes of Step S601 and its subsequent steps are performed.

The deletion of the register mark data in Step S602 may be made by any method, which is not necessarily limited to a specific one.

For example, according to one method, where the designation of "registration colors" outputted for every plate at the time of creating the register mark data in an editing step may be made in such a manner as: C=0, Y=0, M=0, K=100. This designation allows the register mark data to be left only in the image data for the K plate, while being deleted from the image data for the other plates.

According to another method, the designation of registration colors may be made in a RIP process for creating image data, so that an image is formed only on the K plate (corresponding to "a predetermined plate" in the present invention). This method also allows the register mark data to be left only in the image data for the K plate, while being deleted from the image data for the other plates.

According to still another method, data (corresponding to "converted data" in the present invention), which has been converted to image data, is created based on only data to which registration colors have been designated in a RIP process for creating image data; XOR is calculated over the respective bits of this converted data and the image data for each of the C, M and Y plates (corresponding to "plates other than a predetermined plate" in the present invention); and the calculated result is stored as data for each plate. According to this method, the data, for which XOR has been calculated, corresponds to data in which images of the register mark data designated by registration colors are deleted, and therefore the register mark data is created only in image data for the K plate, while the register mark data is deleted from the image data for the other plates.

FIG. 8 illustrate an example of image data (optimized image data) for the respective printing plates created through the optimization process according to this embodiment. That is, these Figures illustrate an example of the optimized image data for the respective printing plates created by the methods described with reference to such as FIGS. 6 and 7.

FIG. 8(*a*) illustrates optimized image data 75C created for the C plate; FIG. 8(*b*) illustrates optimized image data 75M created for the M plate; FIG. 8(*c*) illustrates optimized image data 75Y created for the Y plate; and FIG. 8(*d*) illustrates optimized image data 75K created for the K plate. Herein, a case is presented, in which the register mark data are deleted from the optimized image data 75C, 75M, 75Y for the C, M, Y plates, while the register mark data is left in the optimized image data 75K for the K plate.

Figure 11:
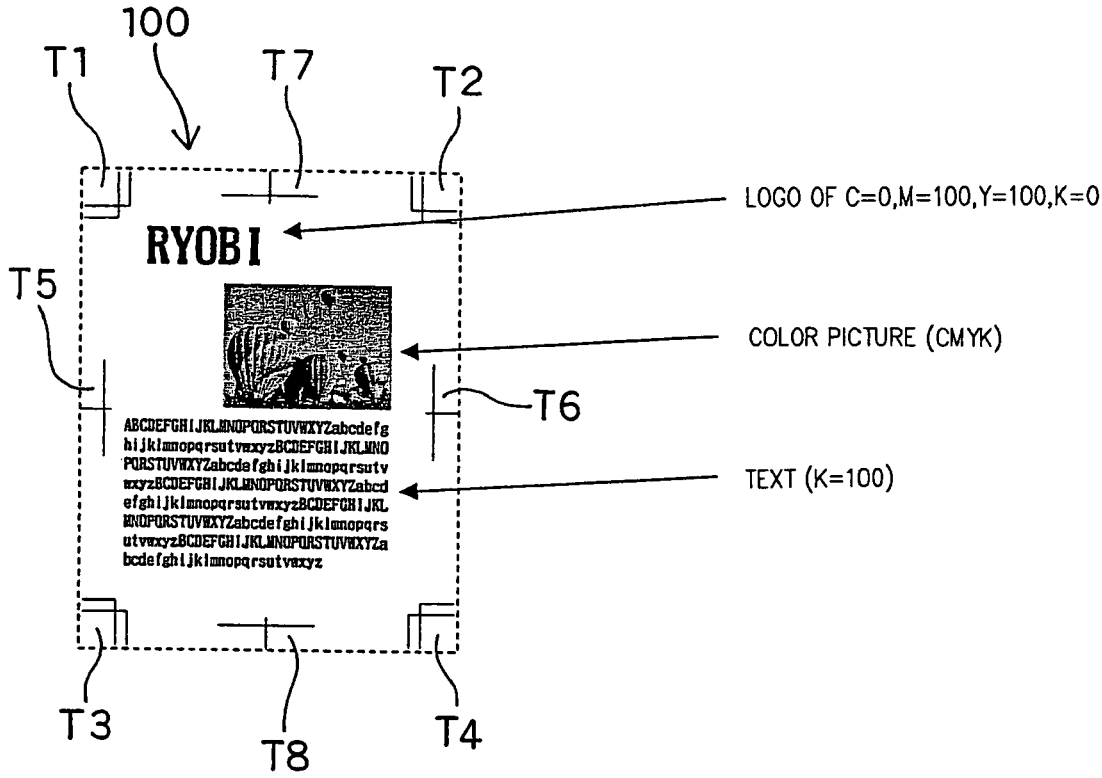
FIG. 11 is a schematic view of a print.

In this embodiment, the respective printing plates are formed by using the thus created optimized image data 75C, 75M, 75Y, 75K, thereby processing printing by using the respective printing plates. Thus, print 100 as illustrated in FIG. 11 can be produced.

That is, according to the digital printing press of this embodiment, it is not necessary to provide register mark data for the purpose of the adjustment in alignment of colors to be printed, thanks to its highly accurate alignment capability. Therefore, it is possible to produce print 100 (see FIG. 11) without misalignment or the like even by using the data 75C, 75M, 75Y, 75K (data without the register mark data) for the respective plates as illustrated in FIG. 8.

Thus, the optimized image data without the register mark data has less data amount as compared with conventionally used data, which contains the register mark data. This allows the memory capacity of the memory part 22 in the control device 20 to be small in this embodiment, and it is possible to shorten the time to transfer the data.

According to this embodiment, a printing image region (the maximum position P) generated in each plate is detected; the size of image data is optimized based on the detected result; and a printing late is formed by using this optimized image data. In forming each printing plate, the amount of the printing film 1 to be fed is automatically controlled, as described with reference to FIGS. 2–4. In this control, image data used is preferably created as small as possible, so that the printing film 1 can more efficiently be consumed.

Therefore, in this embodiment, an image is formed based on the optimized image data by using the image forming device 7 so as to consume the printing film 1 only for a printing region to which printing is performed at each printing unit. This allows reduction in the amount of the printing film 1 to be consumed, as well as reduction in running cost of the digital printing press. That is, since the amount of the printing film 1 used corresponding to the printed range is optimized based on the image to be printed, it is possible to significantly reduce the cost as compared with a conventional case where the printing film is consumed corresponding to the entire plate size (printing sheet size or the like).

Further, in this embodiment, as described above, it is possible to leave the register mark data only in a predetermined plate (e.g., the K plate). Accordingly, it is possible to perform deletion of the register mark data and optimization of the image data for the plates other than the predetermined plate, while allowing production of print 100 having the register mark data for use in cutting or other operation.

It is to be noted that the present invention is not limited to the above embodiment. It is possible to carry out various modifications other than those described above, as long as they fall within the scope of the present invention.

For example, in this embodiment, the description was made by taking for example the case where the register mark data is left in the image data for the K plate. The present invention is not limited to this case. It is possible to employ an arrangement where the register mark data is left in image data for a plate other than the K plate.

The invention claimed is:

1. A data creating device for printing plates that optimizes image data for use in forming printing plates, using a printing press comprising a feed reel for feeding a printing film onto a circumference of a plate cylinder from a circumference recess formed in said plate cylinder, a rewind reel for rewinding said printing film fed from said feed reel so as to draw said printing film from said circumference of said plate cylinder, and an image forming device for forming an image on said printing film placed on said circumference of said plate cylinder, wherein said data creating device detects a maximum position of said image data in a plate transfer direction;

said data creating device deletes data downstream of said maximum position in said plate transfer direction, thereby creating optimized image data;

said data creating device stores said optimized image data in a memory to be used in forming said printing plates; and said data creating device controls an amount of printing film to be fed onto said circumference of said plate cylinder of said printing press for each printing operation using said optimized image data to form said printing plates, so that an image for said each printing operation is formed on said printing film by said image forming device with a leading edge of each printing sheet to be printed positioned at an edge of said rewind reel of said circumference of said plate cylinder.

2. A data creating device for printing plates that optimizes image data for use in forming printing plates, using a printing press comprising a feed reel for feeding a printing film onto a circumference of a plate cylinder from a circumference recess formed in said plate cylinder, a rewind reel for rewinding said printing film fed from said feed reel so as to draw said printing film from said circumference of said plate cylinder, and an image forming device for forming an image on said printing film placed said circumference of said plate cylinder, wherein said data creating device deletes register mark data in said image data;

said data creating device detects a maximum position of said image data in a plate transfer direction;

said data creating device deletes data downstream of said maximum position in said plate transfer direction, thereby creating optimized image data;

said data creating device stores said optimized image data in a memory to be used in forming said printing plates; and said data creating device controls an amount of printing film to be fed onto said circumference of said plate cylinder of said printing press for each printing operation using said optimized image data to form said printing plates, so that an image for said each printing operation is formed on said printing film by said image forming device with a leading edge of each printing sheet to be printed positioned at an edge of said rewind reel of said circumference of said plate cylinder.

3. A data creating device for printing plates that optimizes image data for use in forming printing plates, wherein said data creating device deletes register mark data in said image data;

said data creating device detects a maximum position of said image data in a plate transfer direction;

said data creating device deletes data downstream of said maximum position in said plate transfer direction, thereby creating optimized image data; and said data creating device stores said optimized image data in a memory to be used in forming said printing plates, wherein color designation of 0 is applied to printing plates other than a predetermined printing plate at the time of creating said register mark data, thereby deleting said register mark data.

4. A data creating device for printing plates that optimizes image data for use in forming printing plates, wherein said data creating device deletes register mark data in said image data;

said data creating device detects a maximum position of said image data in a plate transfer direction;

said data creating device deletes data downstream of said maximum position in said plate transfer direction, thereby creating optimized image data; and said data creating device stores said optimized image data in a memory to be used in forming said printing plates, wherein a registration color is not formed in image data for printing plates other than a predetermined printing plate by a RIP that creates image data, thereby deleting the register mark data for said printing plates other than the predetermined printing plate.

5. A data creating device for printing plates that optimizes image data for use in forming printing plates, wherein said data creating device deletes register mark data in said image data;

said data creating device detects a maximum position of said image data in a plate transfer direction;

said data creating device deletes data downstream of said maximum position in said plate transfer direction, thereby creating optimized image data; and said data creating device stores said optimized image data in a memory to be used in forming said printing plates, wherein a RIP for creating image data creates converted data that have been converted to image data based only on data to which a registration color has been designated, and XOR is calculated between said converted data and data for said printing plates other than the predetermined printing plate, thereby deleting the register mark data for the printing plates other than the predetermined printing plate.

* * * * *